US009797581B2

(12) United States Patent
Tang et al.

(10) Patent No.: US 9,797,581 B2
(45) Date of Patent: Oct. 24, 2017

(54) LAMP

(71) Applicants: Yi-Wen Tang, Taichung (TW); Tian-Yong Zhang, Taichung (TW)

(72) Inventors: Yi-Wen Tang, Taichung (TW); Tian-Yong Zhang, Taichung (TW)

( * ) Notice: Subject to any disclaimer, the term of this patent is extended or adjusted under 35 U.S.C. 154(b) by 17 days.

(21) Appl. No.: 15/042,129

(22) Filed: Feb. 11, 2016

(65) Prior Publication Data

US 2017/0234513 A1 Aug. 17, 2017

(51) Int. Cl.

| | |
|---|---|
| ***F21V 19/02*** | (2006.01) |
| ***F21S 8/00*** | (2006.01) |
| ***F21S 8/04*** | (2006.01) |
| ***F21V 19/00*** | (2006.01) |

(52) U.S. Cl.

CPC ..... *F21V 19/02* (2013.01); *F21S 8/033* (2013.01); *F21S 8/04* (2013.01); *F21V 19/006* (2013.01)

(58) Field of Classification Search

CPC ..... F21V 19/02; F21V 19/006; F21S 8/033; F21S 8/04

See application file for complete search history.

(56) References Cited

U.S. PATENT DOCUMENTS

| | | | | |
|---|---|---|---|---|
| 6,135,624 | A * | 10/2000 | Masters | F21V 21/116 362/145 |
| 6,171,061 | B1 * | 1/2001 | Hsu | F04D 25/088 416/244 R |
| 7,401,939 | B2 * | 7/2008 | Haugaard | F21V 21/02 362/147 |
| 2010/0329885 | A1 * | 12/2010 | Criner | F04D 29/601 416/244 R |

* cited by examiner

*Primary Examiner* — Thomas M Sember

(57) ABSTRACT

A lamp includes a first body and a second body. The first body has a protrusion, a first engaging portion and two ribs. The second body has a second engaging portion which is engaged with the first engaging portion. The second engaging portion has two L-shaped connection slots with which the ribs are engaged. The second body has a first guide path and three second guide path. Two inclined ramps are located in the first guide path so that the protrusion of the first body slides along the inclined ramps to guide the first engaging portion to be engaged with the second engaging portion. The protrusion is restricted by the contact faces of the blocks to restrict that the second body can only be rotated in one direction to engage the ribs with the connection slots.

9 Claims, 13 Drawing Sheets

B-B

LAMP

BACKGROUND OF THE INVENTION

1. Fields of the invention

The present invention relates to a lamp, and more particularly, to a lamp for being connected to an object.

2. Descriptions of Related Art

The conventional lamp generally comprises a base and a light unit, wherein the base is connected to a ceiling or a wall, and the light unit is connected to the base. The base includes a first engaging portion which has two L-shaped slots in two sides thereof. The light unit has a second engaging portion which is engaged with the first engaging portion. The second engaging portion has two ribs which are engaged with the L-shaped slots. However, most of the light unit is larger than the second engaging portion, and the second engaging portion is located behind the back of the installer, so that the installer cannot sure whether the first and second engaging portions are in alignment with each other. The installer can only adjust the relative position between the first and second engaging portions by touch to guide the ribs to be in alignment with the L-shaped slots, and then to connect the first and second engaging portions. These installing steps take a lot of time.

The present invention intends to provide a lamp which improves the shortcomings mentioned above.

SUMMARY OF THE INVENTION

The present invention relates to a lamp and comprises a first body to be fixed to an object, and the first body has a protrusion protruding therefrom which is a four-side protrusion and has a flat surface. A first engaging portion is a circular recess which is defined in the flat surface of the protrusion. Two ribs are located diametrically in the first engaging portion. The width of the protrusion is a first length.

A second body receives a light member therein and has a second engaging portion at the center thereof. The second engaging portion is engaged with the first engaging portion. The second engaging portion has two connection slots which are located corresponding to the two ribs. Each of the two connection slots is an L-shaped slot and has an opening and a restriction portion. The ribs each enter into the restriction slot corresponding thereto from the opening and are engaged with the restriction portion. Four blocks extend from the top of the second body. One first guide path and three second guide paths are respectively and radially defined between the four blocks. A space is formed at the central portion of the second body and located between the four blocks. The protrusion is accommodated in the space. The second engaging portion is located at the center of the space. Each of the first and second guide paths open through the periphery of the second body. The width of the first guide path is a second length which is longer than the first length. The width of each of the second guide paths is a third length which is smaller than the first and second lengths. The opening of one of the two connection slots orientates the first guide path. Two pieces protrude from the top of the second body and are located in the first guide path. Each of the two pieces has an inclined ramp, and one of the two pieces has a first face extending from one end of the inclined ramp. The first face is located close to the second engaging portion. The height of the first face is equal to or higher than the height of the second engaging portion. Each of the four blocks has a contact face, and four sides of the protrusion contact the contact faces.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
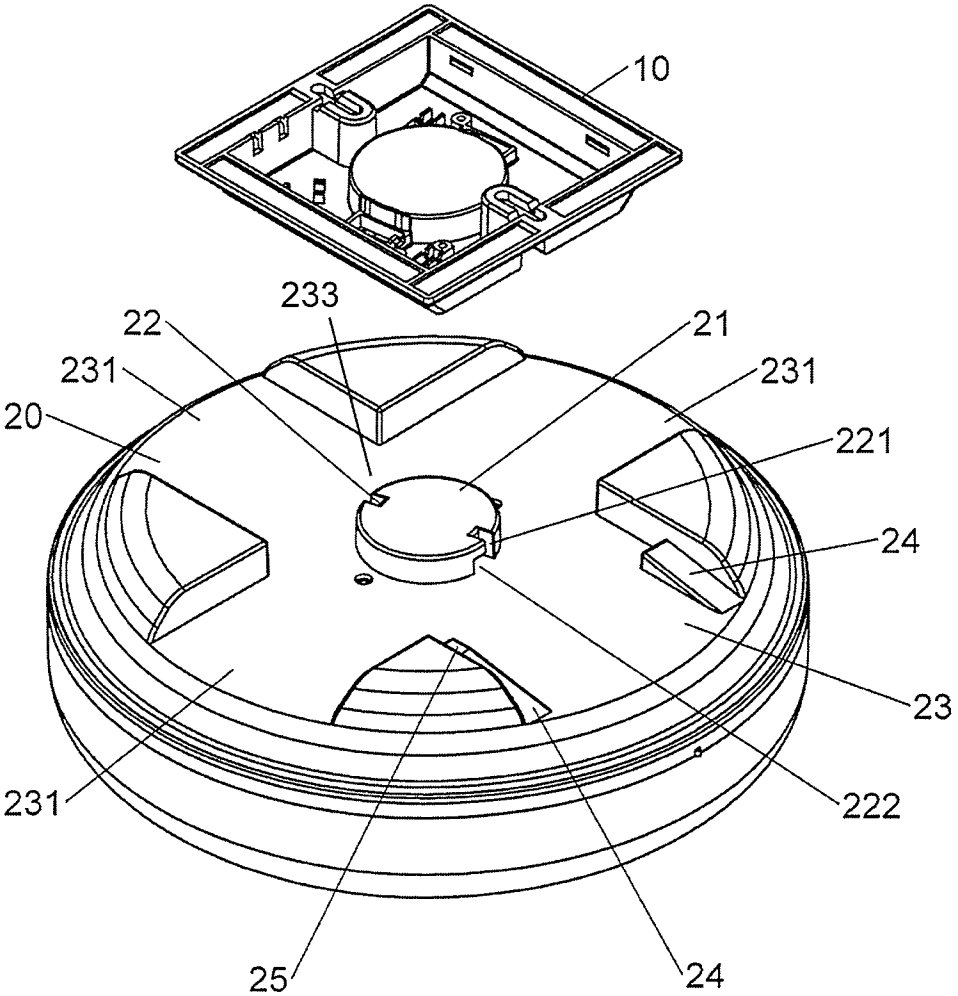
FIG. 1 is an exploded view of the lamp of the present invention.
Figure 3:
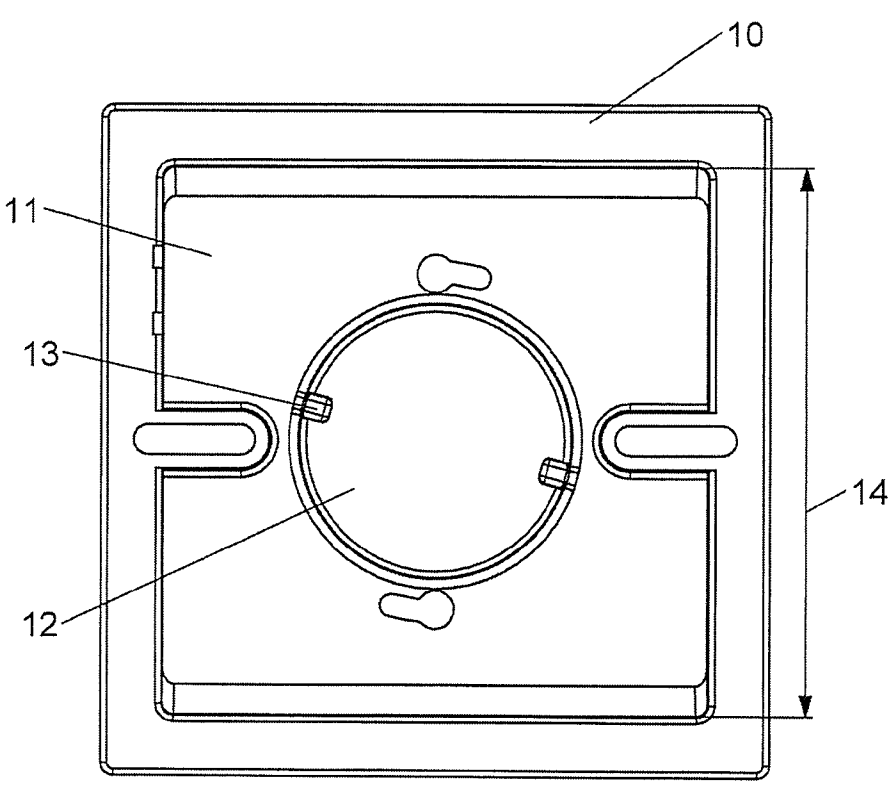
FIG. 3 is a plane view of the first body of the lamp of the present invention.
Figure 2:
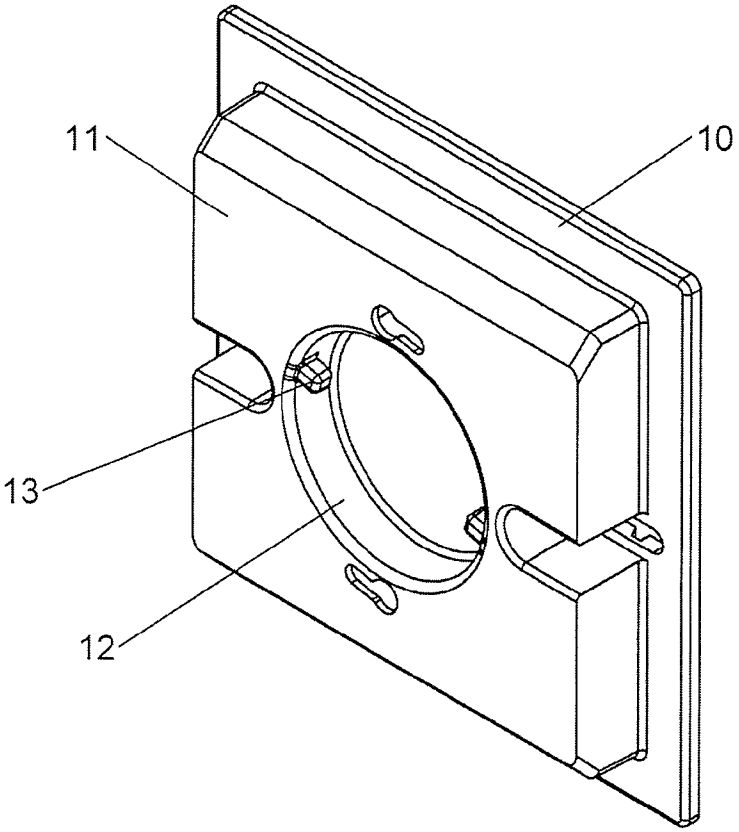
FIG. 2 is a perspective view to show the first body of the lamp of the present invention.
Figure 4:
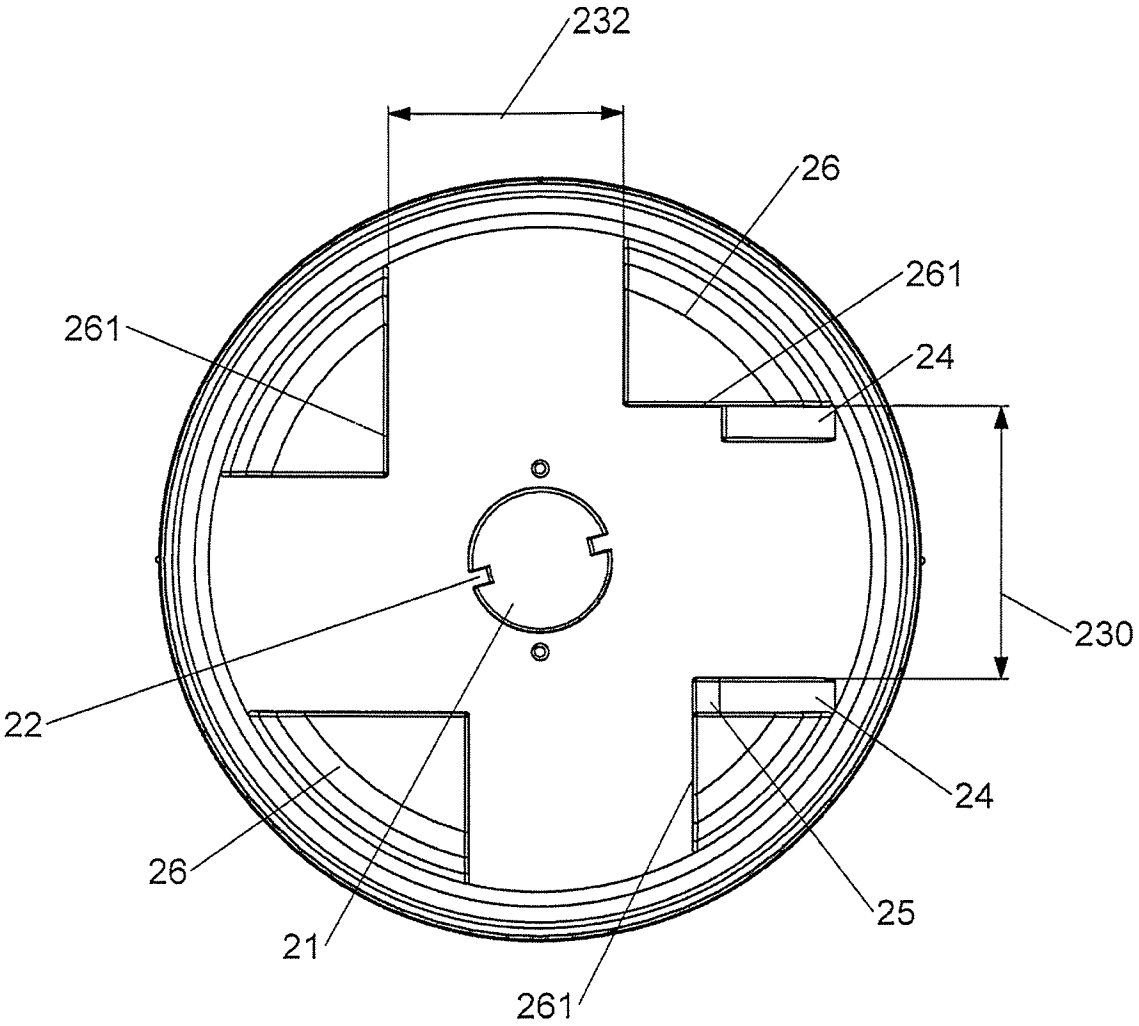
FIG. 4 is a plane view of the second body of the lamp of the present invention.
Figure 5:
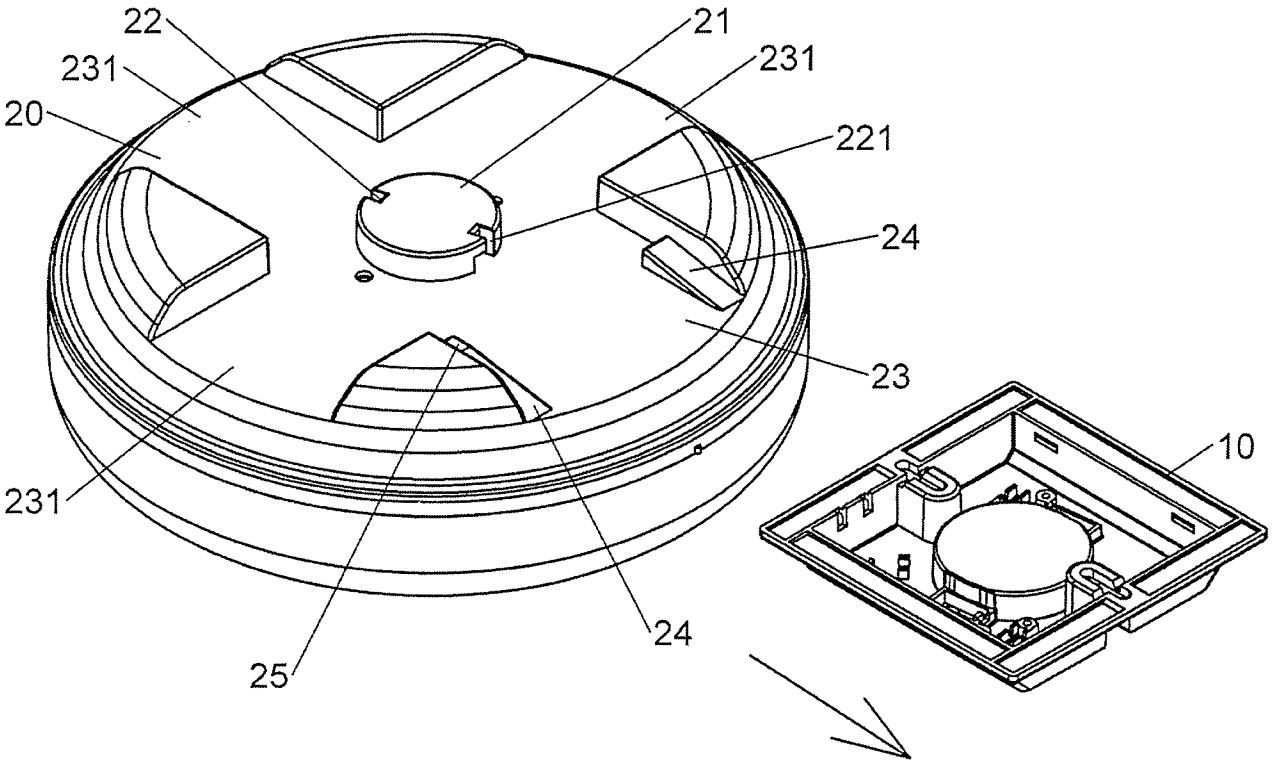
FIG. 5 shows that the second body is moved toward the first body.
Figure 6:
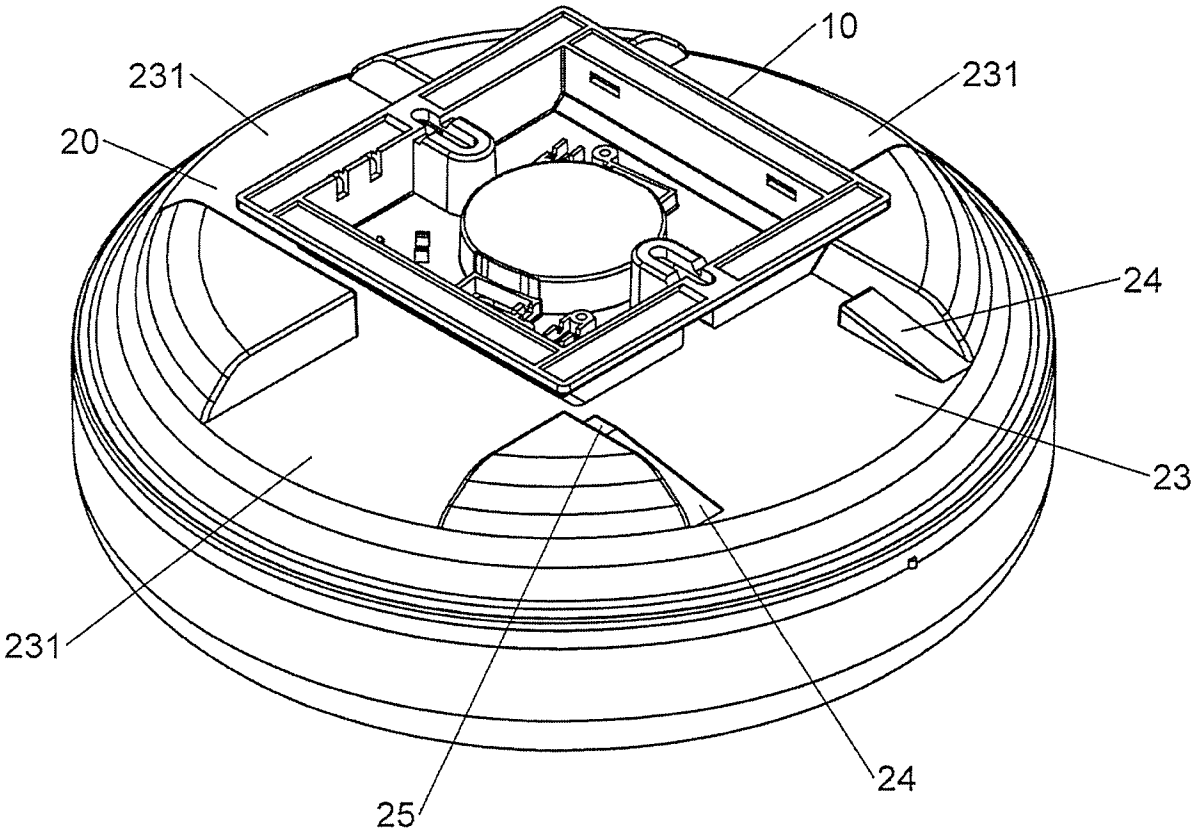
FIG. 6 shows that the first body is guided by the inclined ramps, and the first and second engaging portions are located in alignment with each other.
Figure 8:
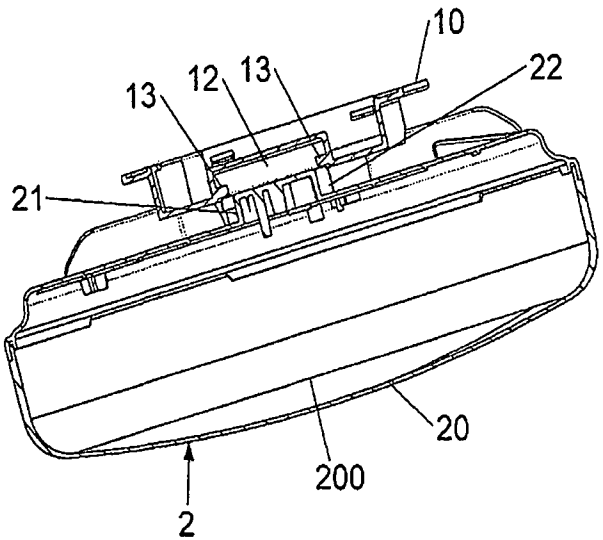
FIG. 8 is a cross sectional view, taken along line A-A in FIG. 7.
Figure 7:
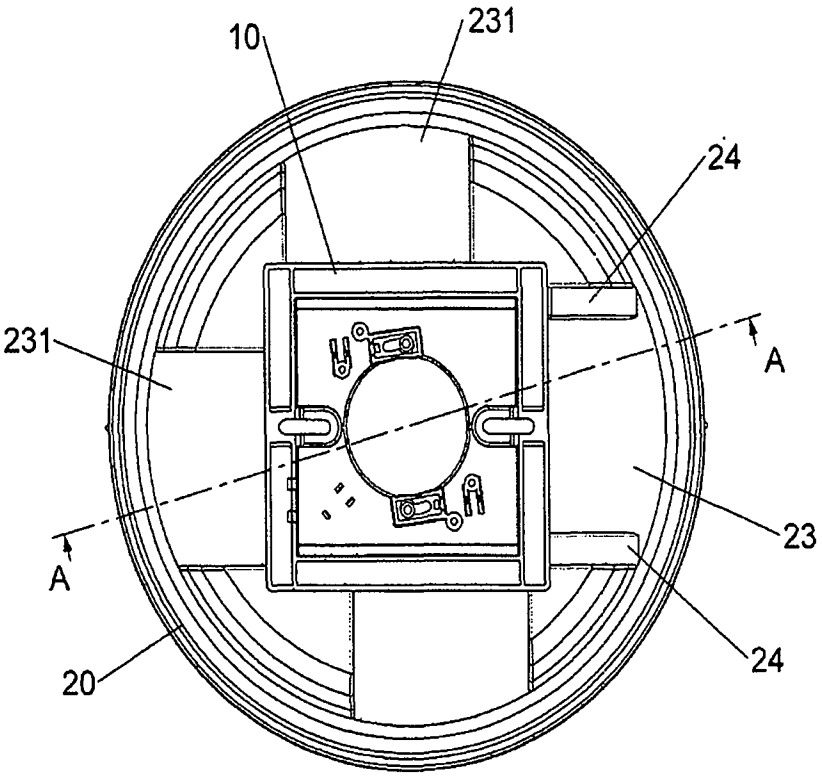
FIG. 7 is a plane view of the disclosure in FIG. 6.

Referring to FIGS. 1 to 4, the lamp of the present invention comprises a first body 10 which is to be fixed to an object such as a ceiling or a wall. The first body 10 has a protrusion 11 protruding from the first side thereof, and the protrusion 11 is a four-side protrusion and has a flat surface. A first engaging portion 12 is a circular recess and defined in the flat surface of the protrusion 11. Two ribs 13 are located diametrically in the first engaging portion 12. The width of the protrusion 11 is a first length 14.

A second body 20 receives a light member therein (not shown), and the second body 20 has a second engaging portion 21 located at the center thereof. The second engaging portion 21 is engaged with the first engaging portion 12. The second engaging portion 21 has two connection slots 22 which are located corresponding to the two ribs 13. Each of the two connection slots 22 is an L-shaped slot and has an opening 221 and a restriction portion 222, so that the ribs 13 each enter into the restriction slot 22 corresponding thereto from the opening 221 and are engaged with the restriction portion 222 by rotating the ribs 13 or the connection slots 22 an angle. Four blocks 26 extend from the top of the second body 20 and arranged in a radial arrangement. One first guide path 23 and three second guide paths 231 are respectively and radially defined between the four blocks 26. A space 233 is formed at the central portion of the second body 20 and located between the four blocks. The second engaging portion 21 is located at the center of the space 223. The protrusion 11 is accommodated in the space 223 when the first body 10 and connected to the second body 20. Each of the first and second guide paths 23, 231 open through the periphery of the second body 20. The width of the first guide path 23 is a second length 230 which is longer than the first length 14. The width of each of the second guide paths 231 is a third length 232 which is smaller than the first and second lengths 14, 230. The opening 221 of one of the two connection slots 22 orientates the first guide path 23. Two pieces protrude from the top of the second body 20 and located in the first guide path 23, wherein each of the two pieces has an inclined ramp 24. One of the two pieces has a first face 25 extending from one end of the inclined ramp 24 and the first face 25 is located close to the second engaging portion 21. The height of the first face 25 is equal to or higher than the height of the second engaging portion 21. Each of the four blocks 26 has a contact face 261 and the four sides of the protrusion 11 are restricted and in contact with the contact faces 261 when installing the first and second bodies 10, 20 together. In this embodiment, the second body 20 is a round body, and the blocks 26 each are a triangular block.

As shown in FIGS. 5 to 8, when connecting the first and second bodies 10, 20, the first body 10 is fixed the ceiling for example, the second body 20 is moved toward the first body 10, and the inclined ramps 24 of the second body 20 contact and move along the protrusion 11 of the first body 10 to move the second engaging portion 21 toward the first engaging portion 12. When the protrusion 11 moves over the first face 25, the second engaging portion 21 is located corresponding to the first engaging portion 12 of the first body 10, and the ribs 13 are located corresponding to the openings 221 of the connection slots 22. The second body 20 receives a light member 200 therein to be a complete lamp 2 of the present invention.

Figure 9:
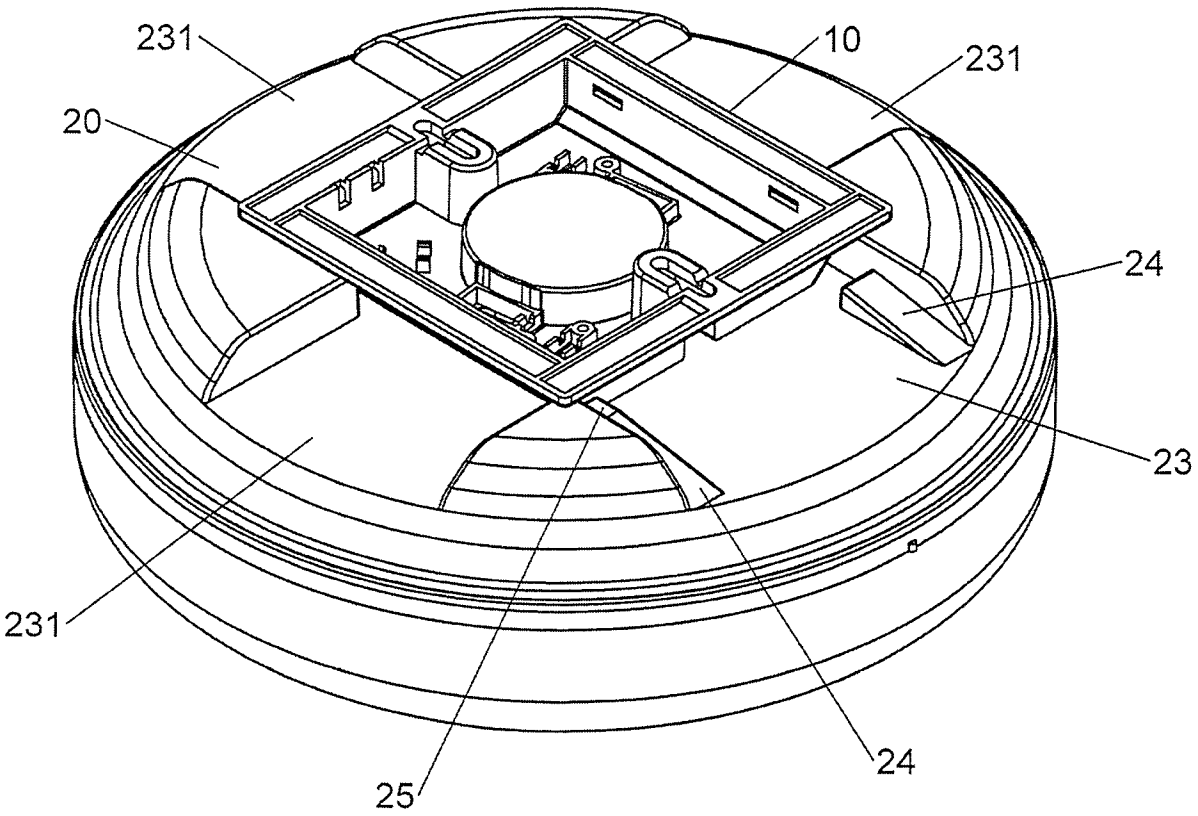
FIG. 9 shows that the first engaging portion is engaged with the second engaging portion.

As shown in FIG. 9, the first and second engaging portions 11, 21 are engaged with each other, and the ribs 13 are located in the openings 221 of the connection slots 22. The sides of the protrusion 11 contact the contact faces 261 of the blocks 26.

Figure 10:
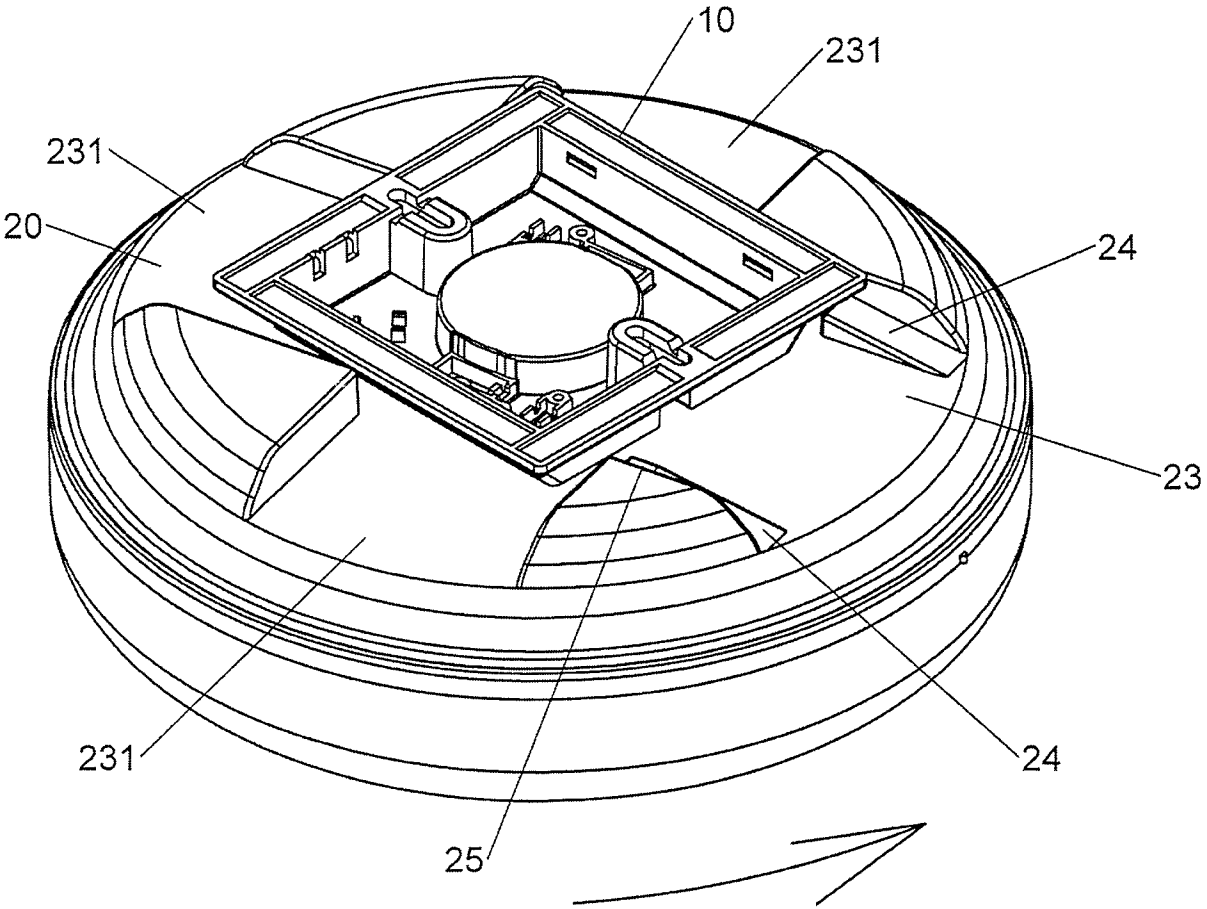
FIG. 10 shows that the second body can only be rotated counter clockwise relative to the first body to engage the ribs with the connection slots.
Figure 12:
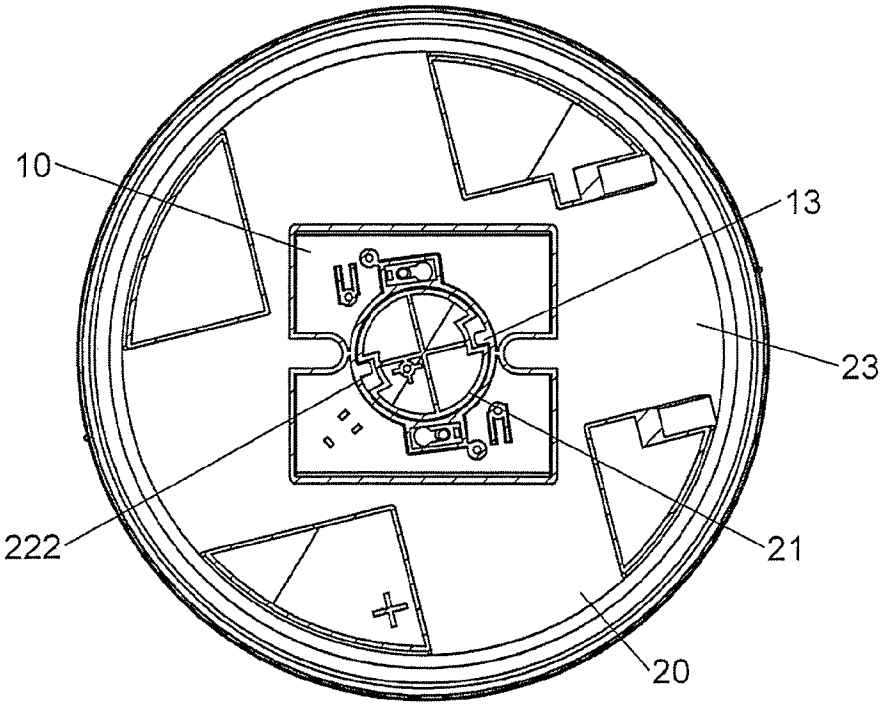
FIG. 12 is a cross sectional view, taken along line B-B in FIG. 11.
Figure 11:
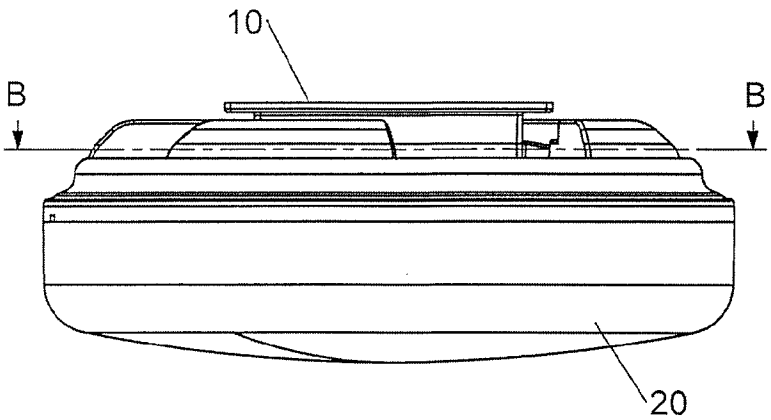
FIG. 11 shows a side view of the disclosure in FIG. 10.

As shown in FIGS. 10 to 12, because the protrusion 11 is restricted by the contact faces 261 of the blocks 26, and the ribs 13 are restricted by the L-shaped connection slots 22, the second body 20 can only be rotated counter clockwise so that the ribs 13 are slid into the restriction portions 222 to connect the first and second bodies 10, 20.

When disassembling the second body 20 from the first body 10, the second body 20 is rotated clockwise, the ribs 13 are shifted from the restriction portions 222 and move to the openings 221 of the connection slots 22. Therefore, the ribs 13 can be removed from the openings 221 to separate the second body 20 from the first body 10. The second body 20 may also be directly connected to the first body 10 as the conventional light assemblies, however, the connection slots 22 are impeded by the second body 20 so that the connection slots 22 are not easily in alignment with the ribs 13.

Figure 13:
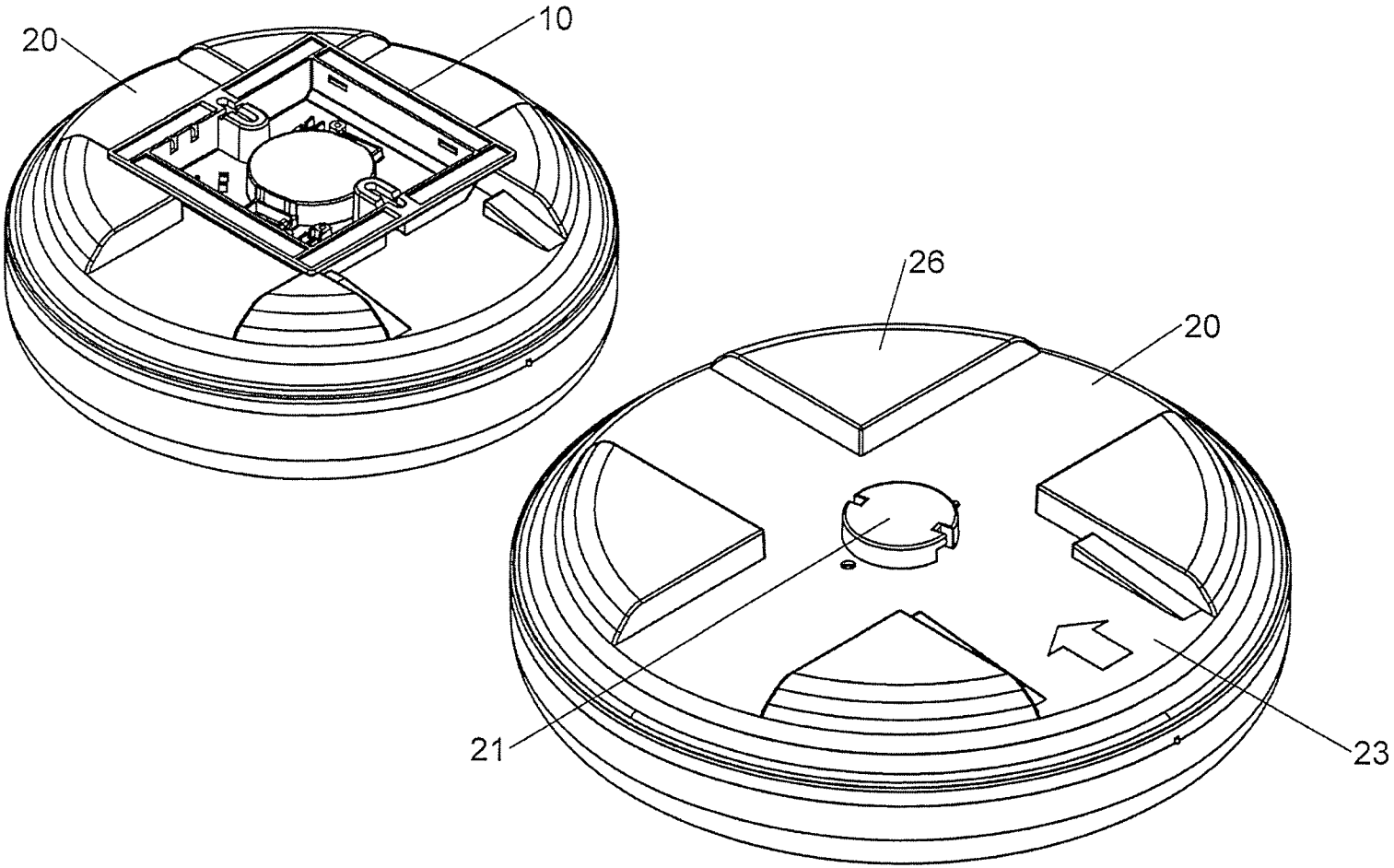
FIG. 13 shows the second embodiment of the lamp of the present invention.

As shown in FIG. 13 which discloses an other second body 20 which still has the second engaging portion 21, the connection slots 22, the first guide path 23, the inclined ramps 24, the first face 25, the blocks 26 and the contact faces 261. The second body 20 in this embodiment is larger than that in the previous embodiment. The second body 20 is a round body, a rectangular body, a pentagon body or a cylindrical body.

Figure 14:
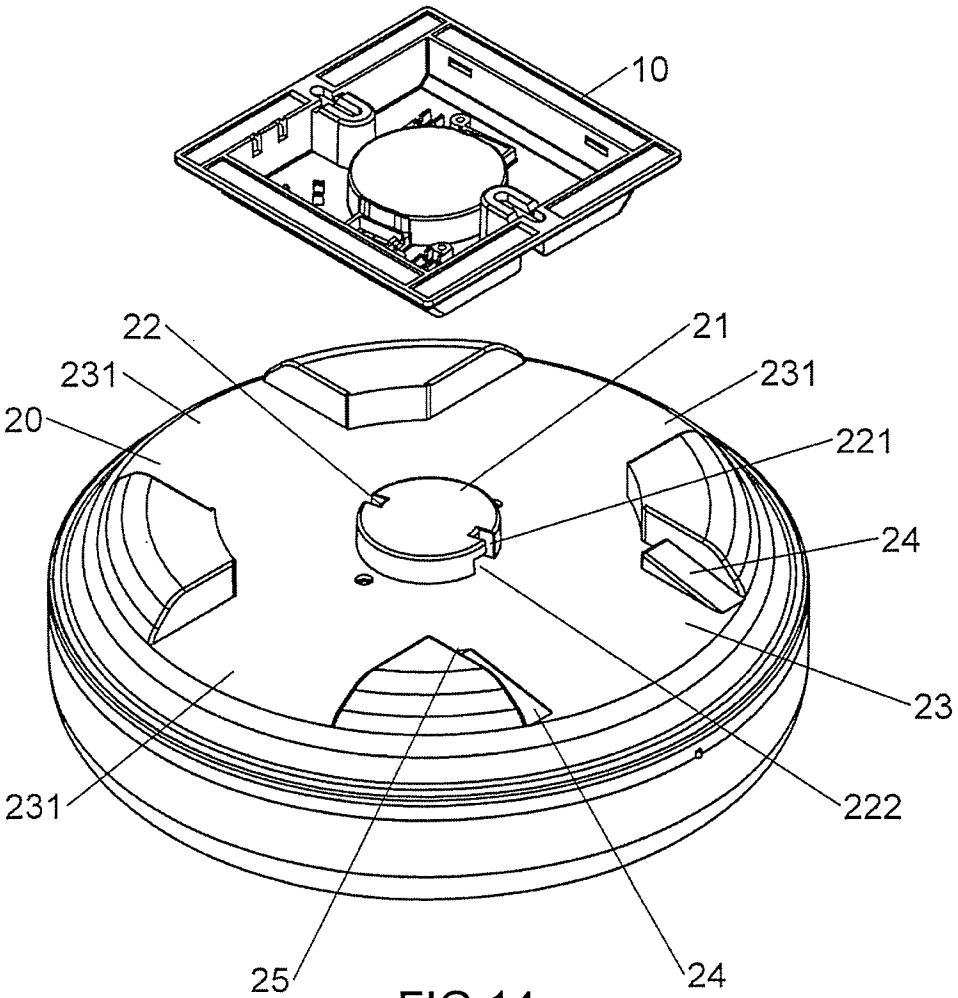
FIG. 14 is an exploded view to show the third embodiment of the lamp of the present invention.

As shown in FIG. 14, the second body 20 has no contact faces 261, and the blocks 26 each are a trapezoid block. The first body 10 is not restricted by the contact faces 261 as mentioned above, the second body 20 is freely rotated relative to the second body 20.

Figure 16:
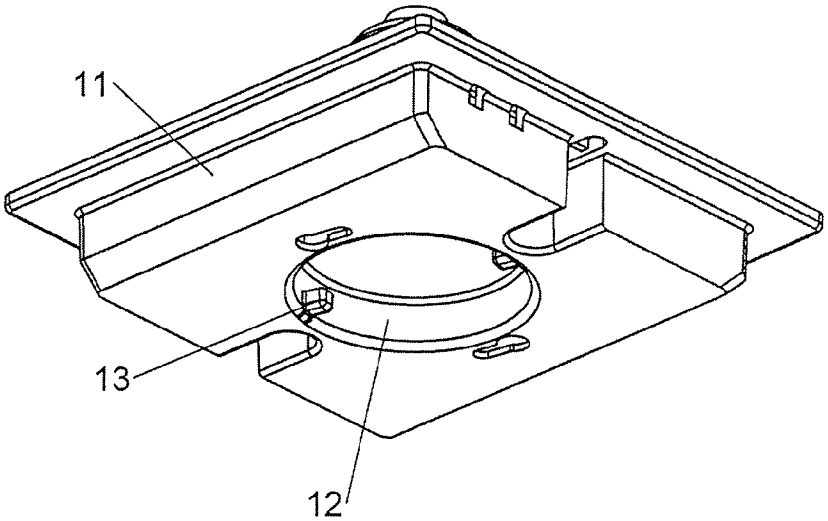
FIG. 16 is another perspective view to show the first body of the fourth embodiment of the lamp of the present invention.
Figure 15:
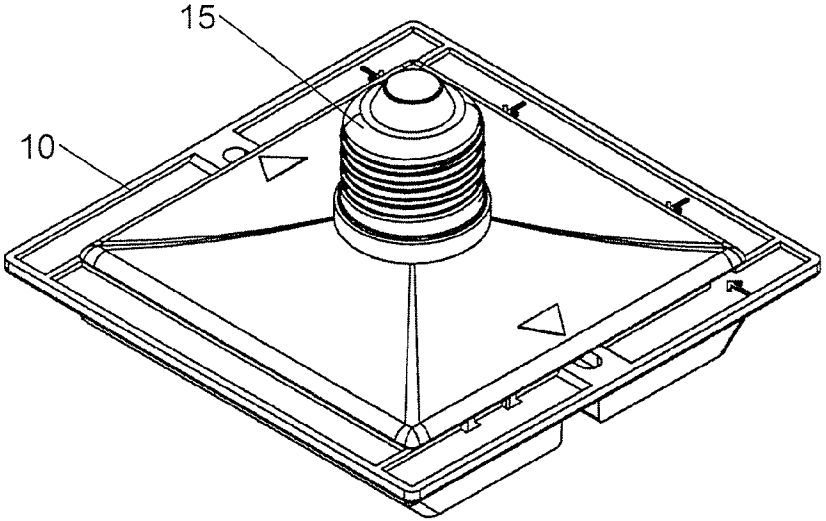
FIG. 15 shows the first body of the fourth embodiment of the lamp of the present invention.

As shown in FIGS. 15 and 16, the first body 10 has a connection member 15 extending from the second side thereof. The connection member 15 has outer threads which are adapted to be threadedly connected to a light base.

Figure 17:
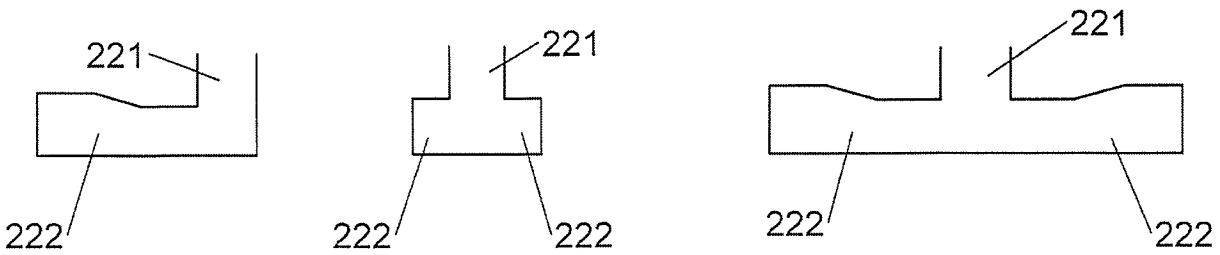
FIG. 17 shows the connection slots of the fifth embodiment of the lamp of the present invention.

As shown in FIG. 17, the blocks 26 of the second body 20 have no contact faces 261, and the connection slots 22 are L-shaped slots or T-shaped slots. The T-shaped slots each have one opening 221 and two restriction portions 222.

The advantages of the present invention is that the assemblers simply move the second body 20 along the first guide path 23 to guide the protrusion 11 of the first body 10 along the two inclined ramps 24 to easily set the second engaging portion 21 to be in alignment with the first engaging portion 12. The four sides of the protrusion 11 of the first body 10 is restricted by the contact faces 261 of the blocks 26 of the second body 20, so that the second body 20 can only be rotated in one direction to slide the ribs 13 into the connection slots 22. The assembling steps are easy and efficient.

While we have shown and described the embodiment in accordance with the present invention, it should be clear to those skilled in the art that further embodiments may be made without departing from the scope of the present invention.

What is claimed is:

1. A lamp comprising:

a first body adapted to be fixed to an object, the first body having a protrusion protruding from a first side thereof, the protrusion being a four-side protrusion and has a flat surface, a first engaging portion defined in the flat surface of the protrusion and being a circular recess, two ribs located diametrically in the first engaging portion, a width of the protrusion being a first length, and a second body adapted to receive a light member therein, the second body having a second engaging portion at a center thereof, the second engaging portion being engaged with the first engaging portion, the second engaging portion having two connection slots which are located corresponding to the two ribs, each of the two connection slots being an L-shaped slot and having an opening and a restriction portion, the ribs each entering into the restriction slot corresponding thereto from the opening and engaged with the restriction portion, four blocks extending from a top of the second body, one first guide path and three second guide paths respectively and radially defined between the four blocks, a space being formed at a central portion of the second body and located between the four blocks, the protrusion being accommodated in the space, the second engaging portion located at a center of the space, each of the first and second guide paths opening through a periphery of the second body, a width of the first guide path being a second length, the second length being longer than the first length, a width of each of the second guide paths being a third length which is smaller than the first and second lengths, the opening of one of the two connection slots orientating the first guide path, two pieces protruding from the top of the second body and located in the first guide path, each of the two pieces having an inclined ramp, one of the two pieces having a first face extending from one end of the inclined ramp, the first face located close to the second engaging portion, a height of the first face being equal to or higher than a height of the second engaging portion, each of the four blocks having a contact face and four sides of the protrusion contacting the contact faces.

2. The lamp as claimed in claim 1, wherein the second body is a round body, and the blocks each are a triangular block.

3. The lamp as claimed in claim 1, wherein the inclined ramps of the second body contact the protrusion of the first body, the inclined ramps of the second body move along the protrusion and toward the first engaging portion, the protrusion moves over the first face, and the second engaging portion is located corresponding to the first engaging portion of the first body, the ribs located corresponding to the openings of the connection slots.

4. The lamp as claimed in claim 1, wherein the protrusion is restricted by the contact faces of the blocks when the first engaging portion is engaged with the second engaging portion, and the ribs are located in the openings of the connection slots, the ribs are restricted by the L-shaped connection slots, the second body is rotated counter clockwise to slide the ribs in the restriction portions of the connection slots.

5. The lamp as claimed in claim 1, wherein the second body is a round body, a rectangular body, a pentagon body or a cylindrical body.

6. The lamp as claimed in claim 1, wherein the second body has no contact faces, the blocks each are a trapezoid block, the second body is freely rotated relative to the second body.

7. The lamp as claimed in claim 1, wherein the first body has a connection member extending from a second side thereof, the connection member has outer threads which are adapted to be threadedly connected to a light base.

8. The lamp as claimed in claim 1, wherein the blocks of the second body have no contact faces, and the connection slots are L-shaped slots or T-shaped slots, the T-shaped slots each have one opening and two restriction portions.

9. The lamp as claimed in claim 1, wherein the ribs each are a rectangular rib.

* * * * *